United States Patent [19]

Kuczenski

[11] 4,455,977

[45] Jun. 26, 1984

[54] COMPRESSION BRAKE SYSTEM

[75] Inventor: Steven R. Kuczenski, New Holstein, Wis.

[73] Assignee: Tecumseh Products Company, Tecumseh, Mich.

[21] Appl. No.: 297,876

[22] Filed: Aug. 31, 1981

[51] Int. Cl.[3] ..... F02B 77/08

[52] U.S. Cl. ..... 123/198 DC; 123/182; 123/321; 123/90.17

[58] Field of Search ..... 123/198 DC, 198 D, 182, 123/320, 321, 90.17

[56] References Cited

U.S. PATENT DOCUMENTS

| | | | |
|---|---|---|---|
| 862,448 | 8/1907 | Cornilleau | 123/90.17 |
| 2,178,152 | 10/1939 | Walker | 123/321 |
| 2,778,349 | 1/1957 | Thommen | 123/182 |
| 3,144,009 | 8/1964 | Goodfellow et al. | 123/90.17 |
| 3,381,676 | 5/1968 | Campen | 123/182 |
| 3,523,465 | 8/1970 | Harrell | 123/90.18 |
| 3,638,632 | 2/1972 | Boling | 123/320 |
| 3,707,952 | 1/1973 | Knebel | 123/320 |
| 3,849,620 | 11/1974 | Melisz | 123/198 DC |
| 3,897,768 | 8/1975 | Thiel | 123/182 |
| 3,981,289 | 9/1976 | Harkness | 123/182 |
| 4,079,721 | 3/1978 | Brown | 123/198 DC |
| 4,194,485 | 3/1980 | Stephenson | 123/198 DC |
| 4,204,384 | 5/1980 | Holtermann | 123/198 DC |
| 4,236,494 | 12/1980 | Fairchild | 123/198 DC |
| 4,338,893 | 7/1982 | Pomfret et al. | 123/182 |
| 4,378,765 | 4/1983 | Abermeth et al. | 123/321 |

*Primary Examiner*—Ira S. Lazarus

*Attorney, Agent, or Firm*—Albert L. Jeffers; John F. Hoffman

[57] ABSTRACT

A safety device for an implement powered by a four-stroke cycle internal combustion engine having a deadman control for reducing the time required to stop the engine when the deadman control is released is disclosed and includes a switch operable upon release of the deadman control to disable the engine ignition system and an arrangement for opening an engine valve at a time other than its normal opening time in the engine cycle. In one preferred embodiment an engine exhaust valve is opened about maximum at 25 degrees prior to top deadcenter position of the engine piston during its compression stroke.

16 Claims, 10 Drawing Figures

COMPRESSION BRAKE SYSTEM

The present invention relates generally to safety devices for internal combustion engine powered implements and more particularly to such safety devices which function to promptly stop the engine in the event that the implement operator moves from his normal operating position.

The need for safety devices for power driven implements to reduce the probability of injury to the operator or others has long been recognized and a wide variety of such safety devices are known. The provision of a protective shield or shroud around dangerous moving parts is commonplace as is the automatic disabling of a dangerous instrumentality when its normal operating mode is interrupted.

A typical illustration of the disabling type safety device is the so-called deadman lever. Such levers are frequently employed on the handle of lawnmowers, garden tillers, snowblowers and the like, and require the operator to be gripping the handle and depressing the lever against a normal spring bias to render the device operational. In the event that the operator releases his grip on the handle, the deadman lever moves typically away from the handle to a position to disable the device. One such known deadman lever disables the ignition circuit on an internal combustion engine rotary lawnmower. Another known deadman lever arrangement is connected to an idler wheel or pulley in the V-belt drive arrangement for a garden tiller with that pulley spring biased toward a position away from the V-belt. Under these conditions the V-belt drive is interrupted since the belt is larger than required to connect the engine to the tiller moving parts and only when the deadman lever is depressed forcing the pulley into engagement with the V-belt and removing slack from the V-belt drive is the tiller operational.

Another known application of a deadman lever to a power driven implement is the interposition of a clutch brake arrangement between the power source such as an internal combustion engine and the dangerous instrumentality such as the rotating blade of a rotary lawnmower or snowthrower. The deadman lever when depressed actuates the clutch to couple the power source to the rotating blade while when the lever is released the clutch is disengaged and a brake actuated to stop the rotary blade.

A further known application of a deadman lever to a power driven implement is illustrated in U.S. Pat. No. 4,204,384 wherein a lawnmower equipped with a two-stroke cycle engine has a deadman lever which actuates a valve in the cylinder head of the mower engine to vent gases from the combustion chamber during the compression stroke of the piston and thereupon closes to prevent entry of gases through the discharge port into the combustion chamber during the expansion stroke of the piston. Somewhat similar valves for two-stroke cycle engine cylinders are illustrated in U.S. Pat. Nos. 4,194,485 and 3,326,194, the first of which illustrates venting the combustion chamber when an ignition switch is in the off position, while the second of these prior art systems illustrates the opening of the special purpose valve when the piston is near top deadcenter and allowing that valve to remain open until the pressure within the cylinder has diminished to about atmospheric pressure with this action being repeated for each compression stroke of the piston. In each of these three prior patented devices, a special purpose valve is required.

Yet another known application of a deadman lever is illustrated in copending U.S. Application Ser. No. 205,010, now U.S. Pat. No. 4,394,893 assigned to the assignee of the present invention, wherein a deadman lever is released to disable an engine ignition system and apply a braking action to the engine flywheel. The principles of this copending application may be used in conjunction with the present invention and features of the present invention may be employed in that device, thereby providing the highly desirable result that the stopping or coastdown time of an internal combustion engine be still further reduced. These principles may be employed individually or in combination to meet the ever increasing stringent requirements imposed by the Government under Consumer Protection Safety Acts to minimize coastdown times on engines such as employed in lawnmowers when such a mower user leaves his normal position at the mower handle.

Among the several objects of the present invention may be noted the provision of an arrangement responsive to a deadman control which when that control is released operates to rapidly stop engine motion; the provision of a safety device for an internal combustion engine powered implement having a deadman control which when released defeats the engine ignition system and employs the naturally occurring compression strokes as the engine coasts down for braking purposes; the provision of a compression braking system for an internal combustion engine wherein the engine exhaust valve is opened at a point in the engine cycle other than its normal opening point to provide an engine braking function; and the provision of a safety device for an engine powered implement which rapidly stops the engine to minimize the risk of injury to an implement operator.

In general and in one form of the invention, a safety device for an internal combustion engine powered implement having a deadman control which is normally biased toward a first position and is actuable by the implement operator to a second or running position reduces the time required for the engine to coast to a stop when the deadman control is released by disabling the engine ignition system upon release of the deadman control and opening an engine valve during continued rotation of the engine at a time other than the normal opening time for that valve in the engine cycle. The valve may be an engine exhaust valve and may be opened at about the time in the engine cycle when ignition would normally occur, thereby venting compressed fuel air mixture from the engine cylinder without combustion.

Also in general, an internal combustion engine has an arrangement for opening an engine exhaust valve at a time in the engine cycle other than its normal opening time to thereby reduce the time required to stop the engine. This arrangement may take the form of an actuating rod axially movable within an engine cam shaft and having a sloped surface for engaging a plunger in that cam shaft movable in a radial direction between retracted and extended positions and operative only in the extended position to open the exhaust valve.

Figure 2:
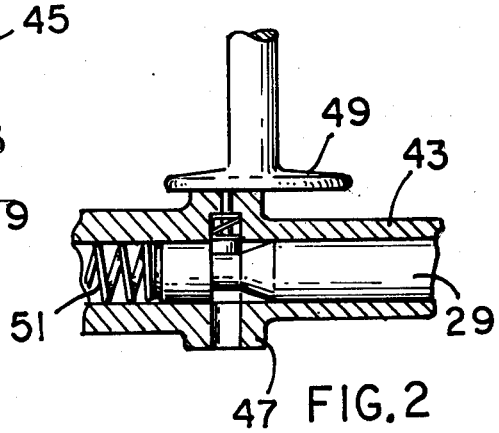
FIG. 2 is a view section along line 2—2 of FIG. 1.
Figure 4:
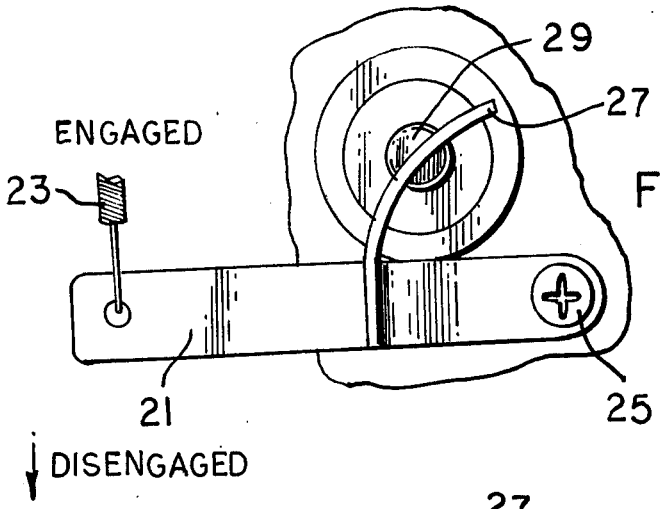
FIG. 4 is a plan view of the lever arrangement for controlling the compression braking system.
Figure 5:
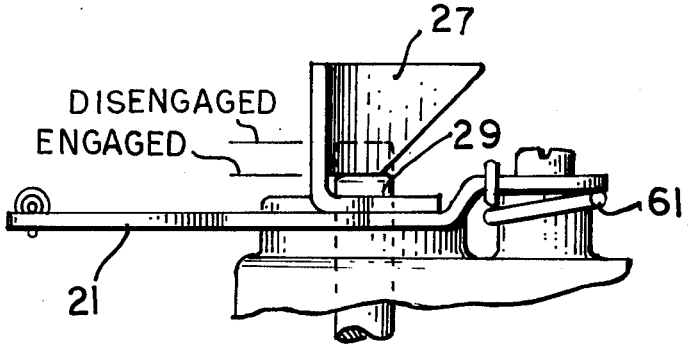
FIG. 5 is a side elevation view of the lever arrangement of FIG. 4.
Figure 6:
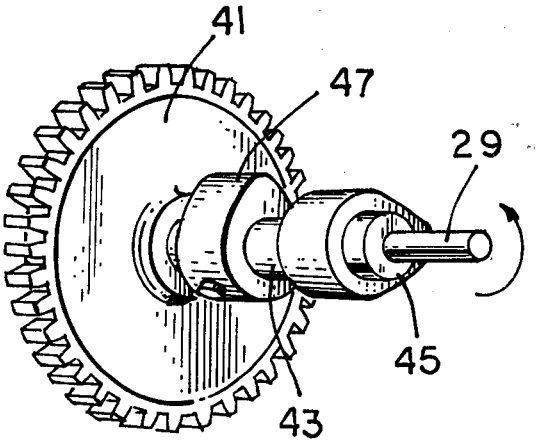
FIG. 6 is a perspective view of the engine cam shaft of FIG. 1.
Figure 6A:
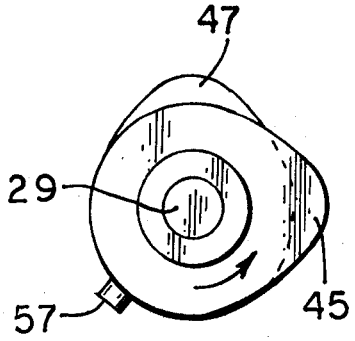
Figure 7:
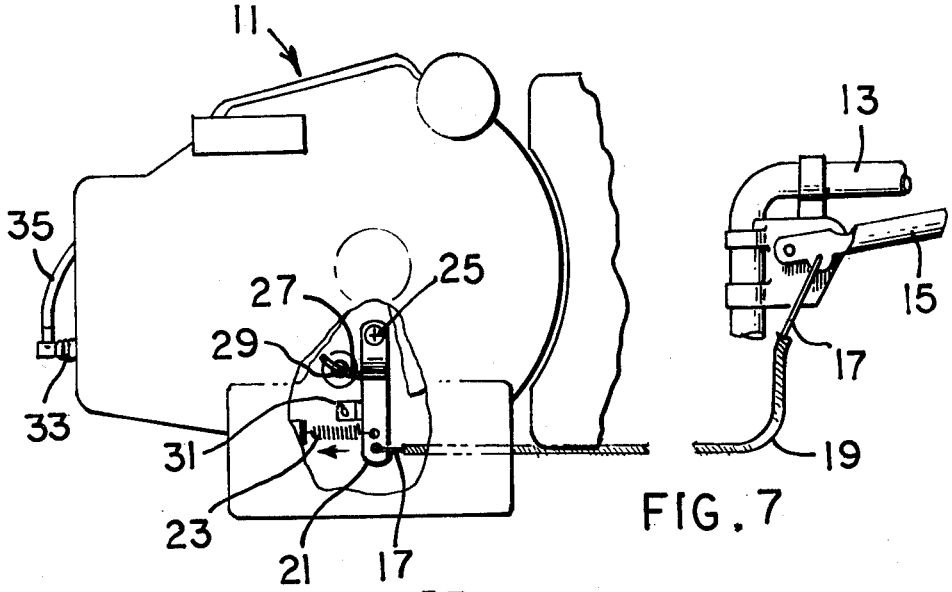
Figure 8:
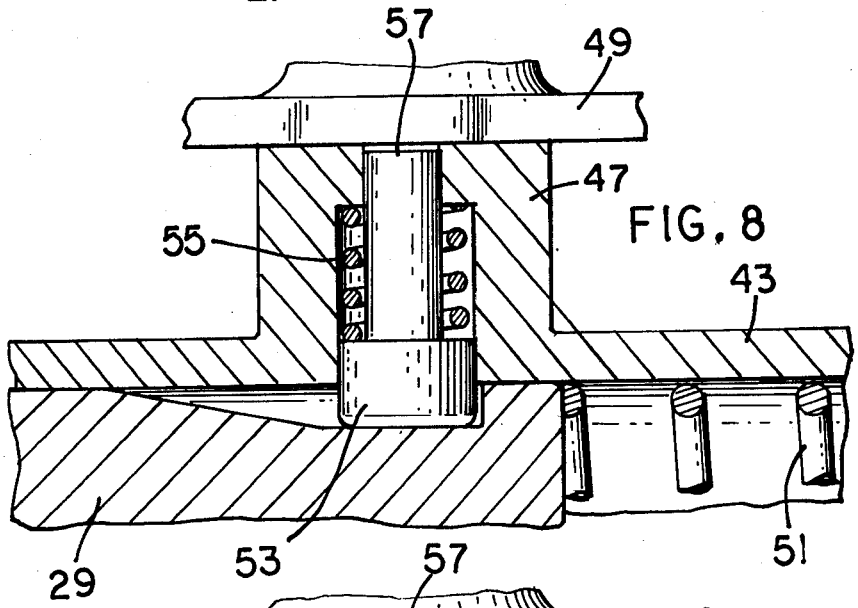

FIG. 6*a* illustrates the angular relationship between the intake and exhaust cam lobes and the valve actuating plunger of the present invention;

FIG. 7 is a top view of an engine and a portion of an implement powered thereby, illustrating the deadman control and ignition grounding switch along with the lever of FIGS. 4 and 5;

FIG. 8 is an enlarged cross-section view analogous to FIG. 2; and

Figure 3:
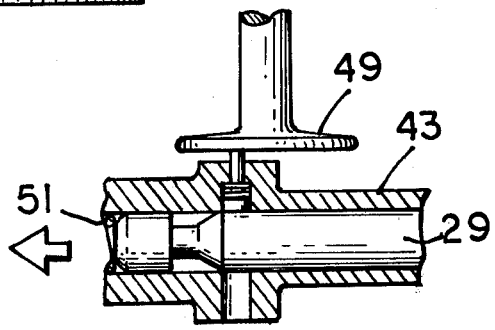
FIG. 3 is a view similar to FIG. 2 but illustrating the compression brake mechanism actuated for halting engine rotation.
Figure 9:
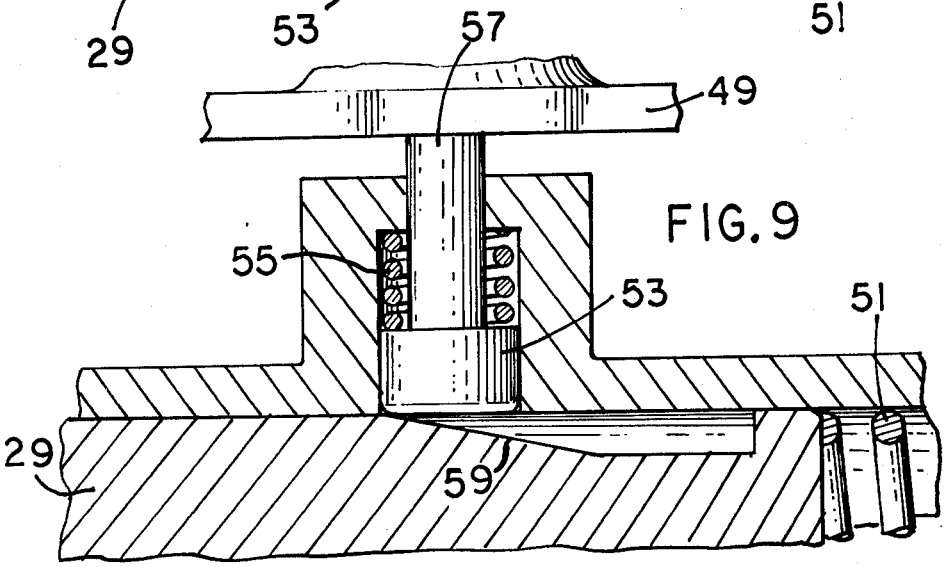

FIG. 9 is an enlarged cross-section view analogous to FIG. 3.

Corresponding parts are identified by corresponding reference characters throughout the several views of the drawing.

The exemplifications set out herein illustrate a preferred embodiment of the invention in one form thereof and such exemplifications are not to be construed as limiting the scope of the disclosure or the scope of the invention in any manner.

Figure 1:
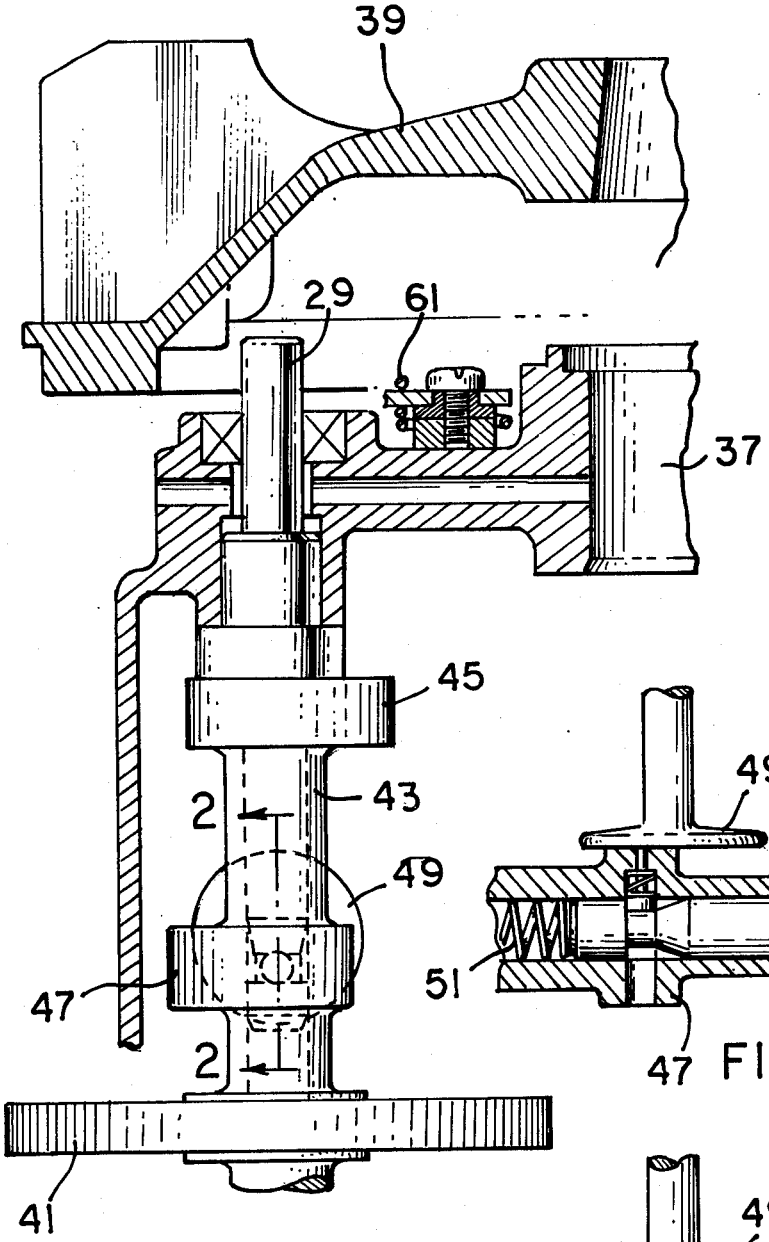
FIG. 1 is a partial section view of a four stroke cycle internal combustion engine illustrating the cam shaft thereof modified in accordance with the teachings of the present invention.

Referring first to FIG. 7, an internal combustion engine 11 powers an implement such as a lawnmower, snowthrower or garden tiller with a handle 13 of that implement illustrated. Thus, for example, the implement might be a walk-behind mower of the rotary type. A deadman control lever 15 is gripped by the implement operator, pulling cable 17 from the sheath 19 of a conventional Boden cable. The other end of sheath 19 is clamped in a conventional manner to the engine or other part of the implement with wire 17 coupled to the free end of a pivotable arm 21. That arm is pivotable about axis 15 and is urged to rotate in a clockwise direction by spring 23 with that spring coupling the free end of the lever or arm 21 to the engine or other relatively fixed part of the implement. Arm 21 includes a sloped portion 27 which engages the upper exposed end of an actuating rod 29 so that the gripping and releasing of the deadman handle 15 and correlative pivoting back and forth of arm 21 causes the depression and release of the actuating rod 29 along an axis perpendicular to the plane of FIG. 7. The details of the actuating rod 29 and its effect on engine operation are best seen in FIG. 1, while the detailed structure of the arm 21 and sloping surface which actuates the actuating rod 29 are most easily seen in FIGS. 4 and 5. When the arm 21 moves to its most clockwise position, corresponding to release of the deadman handle 15 and the contraction of spring 23, arm 21 engages a normally open switch 31 which may be connected in parallel with the primary circuit of a high voltage ignition system so that engagement of the arm 21 and switch 31 closes that switch shorting out the ignition and preventing the induction of high voltage pulses in the high tension lead 35 associated with the spark plug 33 thereby disabling the ignition. An ignition primary circuit may alternatively be shorted to disable the ignition. At this time, the actuating rod 29 is depressed by the sloped surface of the portion 27 of the lever 21 to open an engine exhaust valve near top deadcenter of the compression stroke of the piston.

Referring now to FIG. 1, there is depicted in section a portion of a one cylinder four stroke cycle engine having a vertical crankshaft to drive, for example, a rotary mower blade.

Except as hereinafter noted, the engine of FIG. 1 may be of generally conventional construction having an upper main bearing 37 journaling the engine crankshaft with that crankshaft in turn rotatably supporting a flywheel 39 and a gear, not shown, for drivingly engaging the cam shaft gear 41 so that the cam shaft 43 rotates at one half the rate of the crankshaft. The cam shaft 43 includes a cam lobe 45 for opening a conventional intake poppet valve as well as a cam lobe 47 for opening a conventional exhaust poppet valve with a valve lifter for the exhaust valve being identified in FIGS. 1, 2, 3, 8 and 9 as 49.

Cam shaft 43 is hollow and contains axially movable actuating rod 29, spring loaded by coil spring 51 toward the positions illustrated in FIGS. 1, 2 and 8. Thus, coil spring 51 urges the actuating rod 29 upwardly toward flywheel 39 as viewed is FIGS. 1 and 4. Rotation of the lever 21 forces the actuating rod 29 downwardly from the disengaged position of FIGS. 2 and 8 toward the engaged or compression braking position of FIGS. 3 and 9. Thus, FIGS. 2 and 8 illustrate the normal engine running position of the actuating rod 29 while FIGS. 3 and 9 illustrate the braking position of that actuating rod which the rod assumes when the deadman lever 15 is released.

Cam shaft 43 also includes a plunger 53 axially positioned in the region of the exhaust valve actuating lobe 47 but radially displaced therefrom to lead that lobe 47 by a little over 90 degrees, as illustrated in FIG. 6*a*. The plunger 53 is spring loaded by coil spring 55 radially inwardly so that the surface 57 is normally positioned in the running mode flush with or slightly beneath the surface of the exhaust cam. Movement of the actuating rod 29 from the positions illustrated in FIGS. 2 and 8 toward the positions illustrated in FIGS. 3 and 9, due to the release of the deadman control 15, forces plunger 53 radially outwardly to assume the position illustrated in FIGS. 3 and 9. Under these circumstances, the surface 57 of plunger 53 now engages the valve lifter 49 at about the time that ignition would occur in the engine cycle to open the exhaust port, venting the compressed but unexploded gases from the cylinder. Preferably, this venting of the compressed fuel air mixture from the cylinder is initiated maximum at 25 degrees prior to the piston reaching top deadcenter of its compression stroke.

Thus, when the ignition is disabled, due to the closing of switch 31, the engine begins to coast to a stop. The kinetic energy of the rotating mass of the flywheel, mowerblade, crankshaft and related parts, is consumed in compressing the fuel air mixture within the cylinder, however, the energy stored in this compressed mixture is dissipated by opening the exhaust valve rather than, as in the prior art, leaving that exhaust valve closed, so that the compressed fuel air mixture may reexpand, driving the piston and increasing the time required for the engine to coast to a stop.

The actuating rod 29 has a sloped or tapered surface 59 which engages and moves the plunger 53. This tapered surface may be in the form of a conical frustum. When the operator grips deadman control 15, arm 21 is rotated in a counterclockwise direction, as viewed in FIGS. 4 and 7, to disengage the compression braking mechanism. The operator is thus overcoming the force of spring 23 which may be supplemented by or replaced by a spring 61 in FIG. 1, if desired. So long as the operator maintains the deadman control compressed, the tapered surface of portion 27 of the arm 21 does not overlie the actuating rod 29 and this rod 29 may move upwardly, as urged by spring 51, so that the tapered surface 59 recedes radially inwardly relative to the plunger 53, and the plunger 53 moves radially inwardly under the urging of spring 55. Spring 23 and/or spring 61 is sufficiently strong that on release of the deadman control 15, this spring or springs dominate the coil springs 51 and 55 within the cam shaft, so as to extend plunger 53 and open the exhaust valve earlier than normal in the engine cycle.

From the foregoing it is now apparent that a novel safety device as well as a novel scheme for halting a rotating shaft of a four-stroke cycle internal combustion engine in a very short time interval has been disclosed with this safety feature of halting the shaft being accomplished by disabling the engine ignition and opening the engine exhaust valve when the piston associated therewith is near top deadcenter of the compression stroke, with this novel approach meeting the objects and advantageous features set out hereinbefore as well as others and that modifications as to the precise configurations, shapes and details may be made by those having ordinary skill in the art without departing from the spirit of the invention or the scope thereof as set out by the claims which follow.

I claim:

1. A safety device for an implement powered by an internal combustion engine and having a deadman control normally biased toward a first position and actuable by a person operating the implement to a second position for reducing the time for the engine to come to a stop when the deadman control is released, the engine including inlet and exhaust valves and means for opening said valves at predetermined times in each normal operating cycle of the engine, the safety device comprising: an engine ignition impeding switch operable upon release of the deadman control to disable the engine ignition system, and means operable upon release of the deadman control during continued rotation of the engine for opening one of said engine valves at a time other than its normal opening time in the normal engine cycle.

2. The safety device of claim 1 wherein an engine exhaust one valve is the valve opened.

3. The safety device of claim 2 wherein the engine exhaust valve is opened at about the time in the engine cycle when ignition would normally occur thereby venting compressed fuel air mixture from the engine cylinder without combustion.

4. The safety device of claim 1 wherein the means for opening comprises an actuating rod axially movable within an engine camshaft, and a plunger movable in a radial direction under the control of the actuating rod between a retracted position where normal valve operation is unaffected and an extended position to periodically engage an engine valve lifter opening said one valve.

5. The safety device of claim 4 wherein the plunger is axially aligned with and angularly spaced from an actuating cam lobe for said one valve.

6. The safety device of claim 4 further comprising first spring means for biasing the plunger toward the retracted position.

7. The safety device of claim 4 wherein the actuating ring rod includes a tapered surface for engaging and moving the plunger.

8. The safety device of claim 5 further comprising first spring means for biasing the plunger toward the retracted position and second spring means for biasing the actuating rod toward a position to allow the first spring means to retract the plunger.

9. The safety device of claim 8 wherein an engine exhaust valve is opened by the means for opening at about 25 degrees before the associated piston reaches top deadcenter of its compression stroke.

10. The safety device of claim 4 wherein the means for opening further includes a lever pivotably attached near one end thereof to the engine and having the other end connected to the deadman control for pivotal movement between first and second positions in unison with movement of the deadman control between its corresponding first and second positions, the lever engaging and controlling the actuating rod.

11. The safety device of claim 10 wherein the lever pivots about an axis generally parallel to the actuating rod axis and includes an arm having a sloping surface for engaging and moving the actuating rod in its axial direction when the lever pivots about its axis.

12. The safety device of claim 11 further comprising a spring connected between the lever other end and the engine for urging the lever to pivot about its axis toward the first position thereof.

13. The safety device of claim 12 wherein the spring is the sole means biasing the deadman lever toward its first position.

14. The safety device of claim 10 wherein the ignition impeding switch comprises a normally open switch connected in parallel with an engine spark plug and actuable by movement of the lever to the first position thereof to short circuit the engine ignition system.

15. In an implement powered by an internal combustion engine and having a deadman control normally biased toward a first position and actuable by a person operating the implement to a second position, the engine including inlet and exhaust valves and a mechanism for opening the valves at predetermined times in each normal operating cycle of the engine, a method for reducing the time for the engine to come to a stop when the deadman control is released comprising: causing an engine ignition impeding switch to be operated upon release of the deadman control to disable the engine ignition system, and, further in response to release of the deadman control, opening one of the engine valves during continued rotation of the engine at a time other than its normal opening time in the normal engine cycle.

16. The method of claim 15 wherein the engine exhaust valve is opened to its maximum in response to release of the deadman control at about 25° prior to top deadcenter in the compression stroke of the engine cycle.

* * * * *